US006009976A

United States Patent [19]

Gorney et al.

[11] Patent Number: 6,009,976

[45] **Date of Patent: *Jan. 4, 2000**

[54] LADDER RACK SYSTEM

[76] Inventors: Michael A. Gorney, 24796 Eureka; Guy T. Jones, 3123 Toepfer; Gilbert T. Jones, 1936 Bart, all of Warren, Mich. 48091

[ * ] Notice: This patent issued on a continued prosecution application filed under 37 CFR 1.53(d), and is subject to the twenty year patent term provisions of 35 U.S.C. 154(a)(2).

[21] Appl. No.: 08/853,426

[22] Filed: May 9, 1997

[51] Int. Cl.[7] ..... E04G 1/00

[52] U.S. Cl. ..... 182/129; 248/210

[58] Field of Search ..... 182/129, 115, 182/123, 124; 248/210, 238; 24/306, 442

[56] References Cited

U.S. PATENT DOCUMENTS

| | | | |
|---|---|---|---|
| 2,837,306 | 6/1958 | Elm | 248/210 |
| 2,883,134 | 4/1959 | O'Halloran | 248/210 |
| 3,052,442 | 9/1962 | Rankin, Jr. . | |
| 3,809,351 | 5/1974 | Bravo et al. | 248/210 |
| 3,998,416 | 12/1976 | Benolkin . | |
| 4,077,595 | 3/1978 | Carter et al. | 248/210 |
| 4,643,274 | 2/1987 | Tataseo | 182/106 |
| 4,714,162 | 12/1987 | Harrison | 248/210 |
| 4,964,601 | 10/1990 | Dishman . | |
| 4,979,710 | 12/1990 | Baldwin | 248/210 |
| 5,542,535 | 8/1996 | Dalton . | |

*Primary Examiner*—Daniel P. Stodola
*Assistant Examiner*—Hugh B. Thompson
*Attorney, Agent, or Firm*—Peter D. Keefe

[57] ABSTRACT

A ladder rack system which allows a contractor to locate elongated articles alongside the contractor's ladder while the materials are easily accessible to the contractor at work level, yet the elongated articles are not subject to being carried off by wind. A support member is bucket-like, having a bottom wall and sideways at the rectilinear periphery of the bottom wall for captively receiving the end of elongated articles. A pair of mutually spaced apart rung hooks are connected with each of two opposing sidewalls of the support member for hookably interfacing simultaneously with two rungs of an extension ladder in a selectively removable manner at either side rail of the ladder. At least one rectilinear bracket member has a rung hook for hookably interfacing with a rung of a ladder at either side rail thereof. A boss bracket portion partially occludes an opening of the bracket member. The location of the support member and the spacing of the bracket members is consonant with the length and weight of the elongated articles and the work location on the ladder so that the contractor (or another user) is enabled to easily grab and remove a selected elongated article from the ladder rack system through the opening in the bracket members in rapid response to job progress. An auxiliary ladder rack system may optionally be provided.

10 Claims, 3 Drawing Sheets

LADDER RACK SYSTEM

BACKGROUND OF THE INVENTION

1. Field of the Invention

The present invention relates to the construction trades and to materials and ladders used in association therewith. More particularly, the present invention relates to a rack system which interfaces with selected rungs of a ladder to thereby support readily accessible elongated building materials, such as for example siding.

2. Description of the Prior Art

Commercial and residential construction frequently involves work at the second or third story of the building facade. An example of such work is the installation or repair of aluminum or vinyl siding (hereinafter simply referred to as siding), and the installation or repair of gutters, both of which are usually very elongated.

In the prior art, a contractor will struggle with placing elongated articles (i.e., siding, gutters, etc.) at the work location of the second or third story of the building via an extension ladder. The elongated articles are sometimes stacked against the ladder and then taken as needed. But, the problem with this is that the elongated articles have one end on the ground, which subjects them to dirt and potential damage, and the wind may blow the elongated articles off the ladder thereby resulting in wasted time collecting the blown away elongated articles, as well as potential damage to the elongated articles. Alternatively, a contractor may leave the elongated articles on the ground, then go up and down the ladder repeatedly to carry up the elongated articles, one or two pieces at a time.

Clearly, what remains needed in the art is some system whereby a contractor can locate elongated articles alongside the ladder while being easily accessible to the contractor at the work level, yet not subject to being carried off by wind.

SUMMARY OF THE INVENTION

The present invention is a ladder rack system which allows a contractor to locate elongated articles alongside the contractor's ladder while the materials are easily accessible to the contractor at work level, yet the elongated articles are not subject to being carried off by wind.

The ladder rack system according to the present invention is composed generally of a support member and at least one bracket member. The support member is bucket-like, having a bottom wall and sideways at the periphery of the bottom wall for captively receiving the end of elongated articles (such as for example siding, gutters, downspouts, trim, etc.). The periphery of the support member is preferably rectilinearly shaped. A pair of mutually spaced apart rung hooks are connected with each of two opposing sidewalls of the support member for hookably interfacing simultaneously with two rungs of an extension ladder in a selectively removable manner at either side rail of the ladder. The at least one bracket member is a generally rectilinearly shaped bracket, having a rear bracket portion, a right bracket portion and a left bracket portion. The left bracket portion is provided with a rung hook for hookably interfacing with a rung of a ladder at either side rail thereof. Preferably, the end of the right bracket portion connects with a boss bracket portion which partially occludes an opening of the bracket member opposite the rear bracket portion between the left and right bracket portions.

In operation, a contractor sets up his ladder, then places the ladder rack system onto the ladder as follows. The contractor interfaces the rung hooks of the support member onto selected rungs of the ladder at a selected side rail thereof. Next, the contractor interfaces the rung hook of one, two, three or more bracket members onto the ladder in progressively spaced relation from the support member at the same side rail of the ladder as the support member. With the ladder rack system now in place on the ladder, the contractor then places the end of elongated articles into the support member and eases the materials through the opening of the bracket members. The elongated articles are now supported by the bottom wall and a rear sidewall of the support member, as well as by the rear bracket portion of the bracket members. The sideways of the support member and the left and right bracket portions of the bracket member serve to keep the elongated articles trappingly supported in the ladder rack system even as high winds may blow. Entrapment of the elongated articles is further aided by the boss bracket portion of the bracket members.

The location of the bottom wall and the spacing of the bracket members is consonant with the length of the elongated articles and the work location on the ladder so that the contractor (or another user) is enabled to easily grab and remove a selected elongated article from the ladder rack system through the opening in the bracket members in rapid response to job progress.

Accordingly, it is an object of the present invention to provide a ladder rack system for holding, in a selectively releasable manner, elongated articles against a predetermined side of a ladder.

It is an additional object of the present invention to provide a ladder rack system for holding elongated articles against a predetermined side of a ladder, wherein the components thereof interface with rungs of the ladder in a selectively removable manner.

It is yet another object of the present invention to provide a ladder rack system for holding elongated articles against a predetermined side of a ladder, wherein the components thereof are mutually spaced apart along the ladder to thereby securely support the elongated articles.

These, and additional objects, advantages, features and benefits of the present invention will become apparent from the following specification.

DETAILED DESCRIPTION OF THE PREFERRED EMBODIMENT

Figures 1, 2:
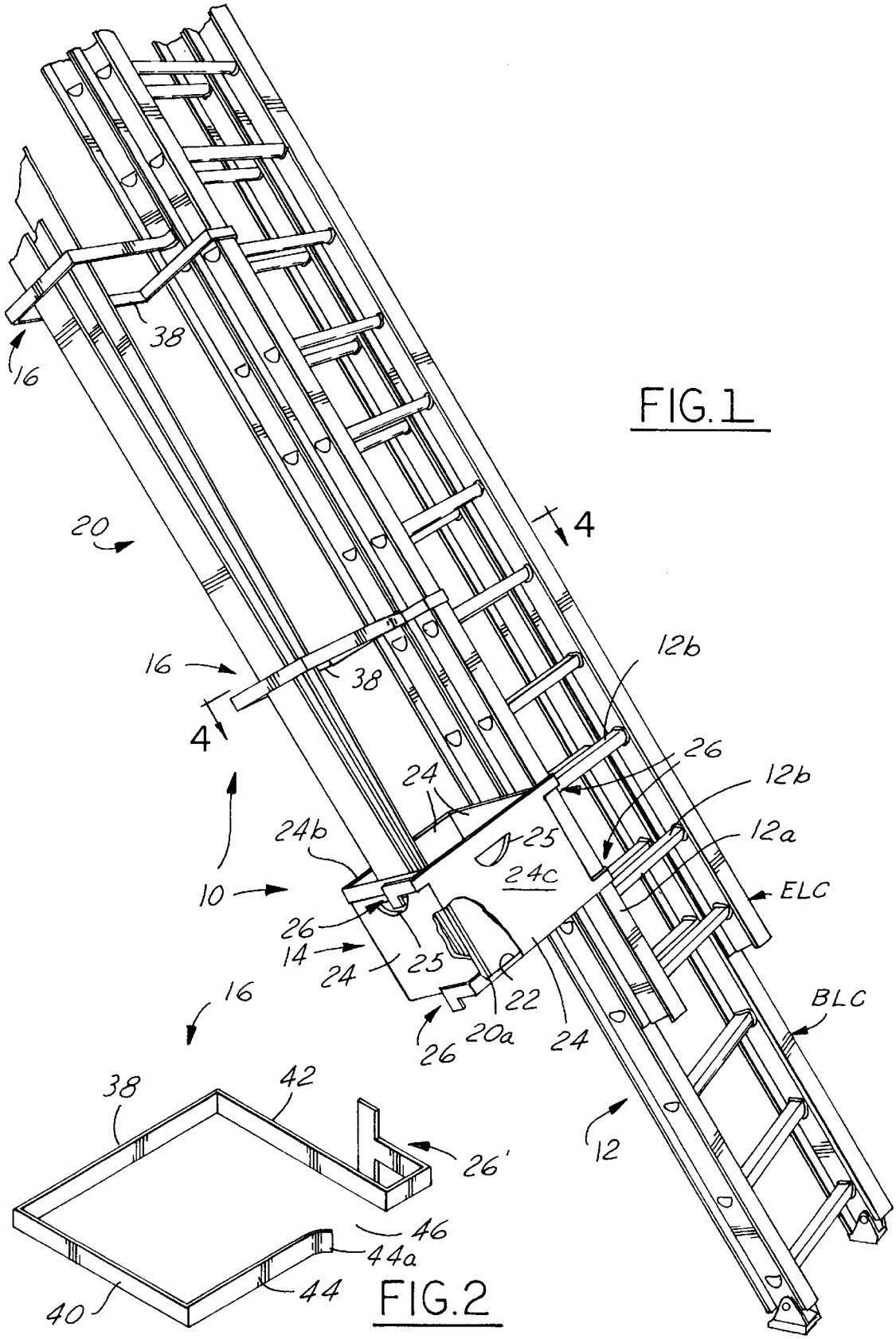
FIG. 1 is a perspective view of the ladder rack system shown in operation with respect to an extension ladder and elongated articles.
FIG. 2 is a perspective view of a bracket member according to the present invention.

Referring now to the Drawing, FIG. 1 generally shows the ladder rack system 10 according to the present invention interfaced with respect to an extension ladder 12. The ladder rack system 10 includes a support member 14 and at least one bracket member 16. The support member 14 and the bracket members 16 interface abuttably with a selected side rail 12*a* and hookably with selected rungs 12*b* of the ladder 12 in a selectively removable manner. Elongated articles 20, such as for example siding, wood trim, gutters, downspouts, etc. have the bottom end 20*a* thereof supported on a bottom wall 22 of the support member 14. Further, the elongated articles are supported above the bottom wall 22 by a rear sidewall 24*b,* and above the support member 14 by the bracket members 16.

Figure 3:
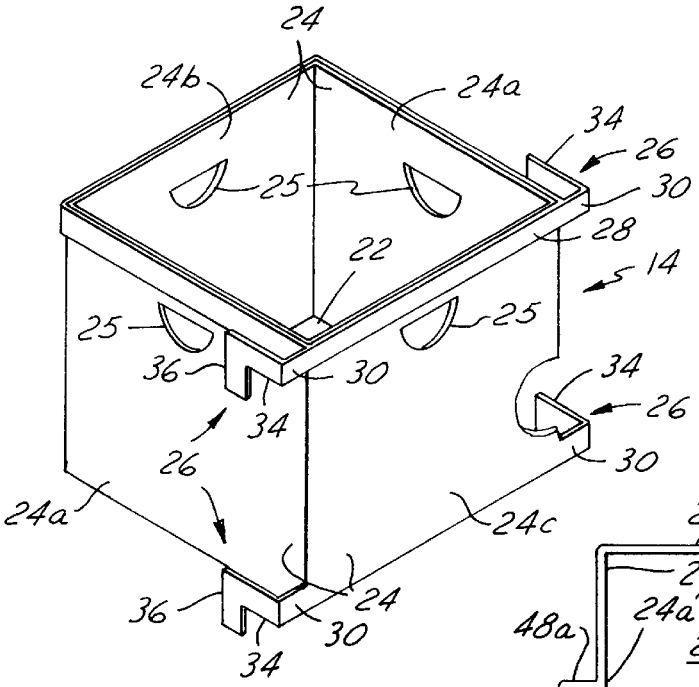
FIG. 3 is a perspective view of a support member according to the present invention.

Referring now to FIGS. 1 and 3 the structure and operational features of the support member 14 will be further detailed.

The support member 14 is preferred to be bucket-like in configuration, preferably rectilinearly shaped. The bottom wall 22 has a periphery to which are connected, in upstanding relation, sidewalls 24. Both the sideways 24 and the bottom wall 22 are preferably flat; and neither the bottom wall nor the sidewalls need to be solid, indeed they may be reticulated. Any strong, durable, corrosive resistant material may be used, such as for example painted steel, anodized aluminum or U-V resistant plastic. Preferably, handholds 25 are provided on the sidewalls 24 adjacent the mouth thereof.

Connected to opposing sidewalls 24*a* of the support member 14 are at least one, preferably two, rung hooks 26. A pair of rung hooks 26 is preferred, in that ladders are rated by the weight that the rungs thereof may safely support. In order to safely place the weight of the elongated articles at the support member 14 upon the rungs 12*b,* the weight is preferred to be distributed upon each of two rungs of the ladder. The rung hooks 26 may be connected to a band 28 which engirds the sidewalls 24, in order that the weight supported by the rung hooks 26 is distributed therearound; alternatively, the rung hooks 26 may be integrally connected with the sidewalls 24. The rung hooks 26 may be otherwise suitably connected to the sidewalls 24, such as for example a pair of rung hooks being formed in a U-shaped channel which is fastened (such as by threaded fasteners), respectively, to each opposing sidewall 24*a*. The rung hooks 26 are provided at both opposing sidewalls 24*a* so as to allow for the support member 14 to be hung to the ladder 12 at either side rail 12*a* thereof.

Each rung hock 26 is composed of a stand-off 30 which is perpendicular to an opposing sidewall 24*a* and generally parallel to, and in line with, the front sidewall 24*c,* a flange 34 which is connected to the stand-off in perpendicular orientation thereto, and a projection 36 which is connected with the flange at an orientation perpendicular to both the stand-off and the flange and facing downwardly (i.e., away from the mouth formed at the sidewalls opposite the bottom wall).

The dimensions of the aforementioned components of the rung hooks 26 are predetermined to interface with the dimensions of a ladder (straight, extension, step, etc.), wherein the rung hocks interfit with the dimensions of the side rails 12*a* and rungs 12*b* thereof. That is, the stand-off 30 is at least as long as the width W of the side rail 12*a,* and the flange is at least as long as the length L between the rear side R of a rung 12*b* and the front side F of the side rail (see FIGS. 4 and 5 with regard to the rung hook 26' for the bracket members 16, which operates similar to the rung hooks 26).

In operation, a user first selects one or the other of the side rails 12*a* of the ladder 12 to which to attach the support member 14. Then the user lifts the rung hooks 26 above selected rungs 12*b* and moves the rung hooks receivably with respect to the front side F of the side rail 12*a.* Lastly, the user lowers the rung hooks onto the selected rungs 12*b* so as to hook thereonto, whereby the flanges 34 rest on the rungs and the projections 36 abut against the rear side R of the rungs. Further, the stand-offs 30 abut against the front side F of the side rail. These interfaces of the rung hooks 26 with the ladder 12 result in the rung hooks stably holding the support member 14 onto the side of the ladder, wherein the bottom wall 22 is generally perpendicular to the side rail 12*a* (see FIG. 1).

To those of ordinary skill in the art it will be appreciated that the rung hooks 26 may be used with any ladder, be that an extension ladder, straight ladder, step ladder, etc. Where an extension ladder is used, the rung hooks 26 are placed onto the extension ladder component ELC so that the support member 14 is attached thereto. The rung hooks 26 are dimensioned so as not to interfere with the respective rungs 12*b* of the base and extension ladder components when the extension ladder component ELC is slid relative to the base ladder component BLC. In this regard, the flange has a length and the projection has a width wherein the projection does not strike the rungs of the base ladder component BLC when the extension ladder component ELC is slid up or down in relation thereto (as shown for example FIG. 4).

Turning attention now to the bracket members 16 and to FIGS. 1, 2, and 4 through 6B, the structure and operational features of the bracket members will be further detailed.

At least one bracket member 16 is provided; however, it is preferred to provide a plurality thereof, such as for example two, three, four, or even more depending on the support needed for the particular elongated articles to be used with the ladder rack system 10. Each bracket member 16 has a rectilinear band-like configuration having a cross-section that dimensionally matches, generally, the cross-section of the sidewalls 24 of the support member 14 (or in other words the cross-section of the periphery of the bottom wall 22). Each bracket member 16 is characterized by a preferably straight rear bracket portion 38, a preferably straight right bracket portion 40 connected to one side of the rear bracket portion, and a preferably straight left bracket portion 42 connected to the other side of the rear bracket portion, wherein the right and left bracket portions are at substantially right angles to the rear bracket portion. The left bracket portion 42 is provided with a rung hook 26' for hookably interfacing with a rung 12*b* of a ladder 12 at either side rail 12*a* thereof. Preferably, the end of the right bracket portion 40 connects with a preferably straight boss bracket portion 44 which partially occludes an opening 46 of the bracket member 16 opposite the rear bracket portion 38 between the right and left bracket portions 40, 42. The terminous of the boss bracket portion 44 is preferred to have an outward bend 44*a* (see FIG. 2) to facilitate manipulation of the elongated articles 20 through the opening 46 when a user is up on the ladder. This feature is useful in that the act of removal of elongated articles will change the user's center of gravity as the user grabs hold thereof, which condition may involve some degree of awkwardness or need of extra care. The boss bracket portion 44 serves to block the elongated articles 20 from being unintentionally dislodged from the bracket members 16 in windy conditions.

Figure 4:
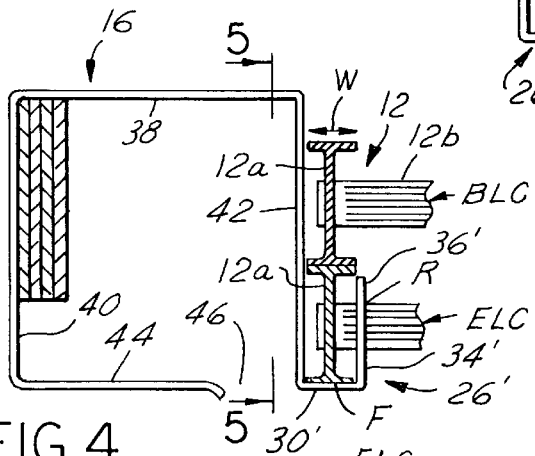
FIG. 4 is a partly sectional top plan view of a bracket member according to the present invention interfaced with a ladder, wherein the ladder is a "heavy duty" type extension ladder.
Figure 5:
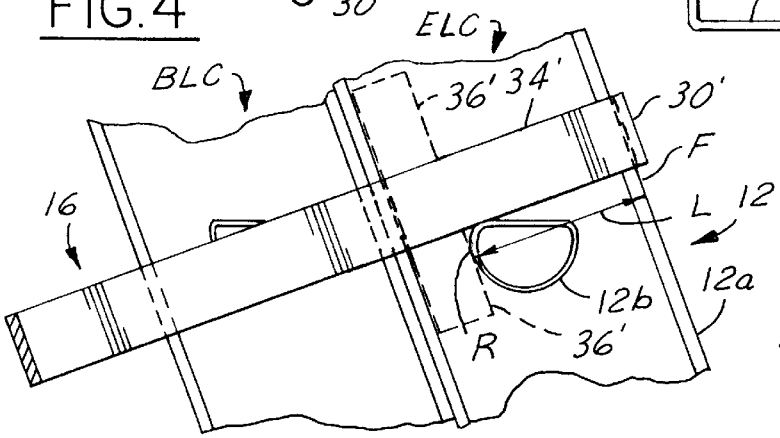
FIG. 5 is a partly sectional, broken away side view along line 5—5 of FIG. 4, showing the bracket member interfaced with the heavy duty type extension ladder.

The structural and operational features of the rung hooks 26' are as recited hereinabove with respect to the rung hooks 26, except that now diametrically opposed projections 36' are provided. As shown at FIGS. 4 and 5, the dimensions of the aforementioned components of the rung hooks 26' are predetermined to interface with the dimensions of a ladder (straight ladder, extension ladder, step ladder, etc.), wherein the rung hocks interfit with the dimensions of the side rails 12*a* and rungs 12*b* thereof. That is, the stand-off 30' is at least as long as the width W of the side rail 12*a,* and the flange 34' is at least as long as the length L between the rear side R of a rung 12*b* and the front side F of the side rail. The diametrical opposition of the projections 36' allows for the bracket member 16 to be connected to the ladder 12 at either side rail 12*a* thereof by simply inverting the bracket member.

Again, any strong, durable, corrosive resistant material may be used for the bracket members 16, such as for example painted steel, anodized aluminum or U-V resistant plastic.

A dimensional example will now be given for exemplary purposes only (and not by way of limitation). The perimeter of the bottom wall 22 is about 12 inches by 12 inches, and the height of the sidewalls 24 from the bottom wall to the mouth is about 12 inches. Each of the rear, right and left bracket portions 38, 40, 42 are about 12 inches long, and the boss bracket portion is about 6 to 8 inches long, and each is about 1 inch in height. With regard to the rung hooks 26, 26', the stand-off is about 1.25 inches long, the flange is about 2.5 inches long and the projection(s) is (are) about 2 inches long and about 1 inch wide.

Operation of the ladder rack system 10 will now be detailed.

In operation, a contractor (or other user) sets up a ladder, then places the ladder rack system 10 onto the ladder as follows. The contractor interfaces the rung hooks 26 of the support member 14 onto selected rungs 12*b* of the ladder at a selected side rail thereof. Next, the contractor interfaces the rung hook 26' of one, two, three or more bracket members 16 onto the ladder in progressively spaced relation from the support member at the same side rail of the ladder as the support member. With the ladder rack system now in place on the ladder, the contractor then places the end of elongated articles 20 into the support member and eases the materials through the opening 46 of the bracket members. The elongated articles are now supported by the bottom wall 22 and the rear sidewall 24*b* of the support member 14, as well as by the rear bracket portion 38 of the bracket members 16. The sidewalls 24 of the support member 14 and the right and left bracket portions 40, 42 of the bracket members 16 serve to keep the elongated articles trappingly supported in the ladder rack system 10 even as high winds may blow. Entrapment of the elongated articles is further aided by the boss bracket portion 44 of the bracket members.

The location of the bottom wall 22 and the spacing of the bracket members 16 is consonant with the length and weight distribution of the elongated articles 20 and the work location on the ladder so that the contractor is enabled to easily grab and remove a selected elongated article from the ladder rack system 10 through the opening 46 in the bracket members in rapid response to job progress.

Figure 6A:
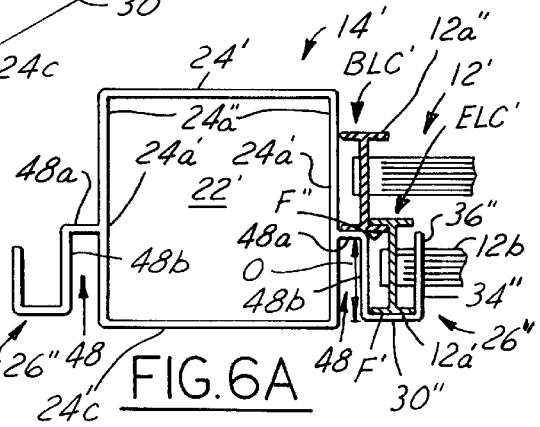
FIG. 6A is a partly sectional top plan view of a support member according to the present invention interfaced with a ladder, wherein the ladder is a "light duty" type extension ladder.
Figure 6B:
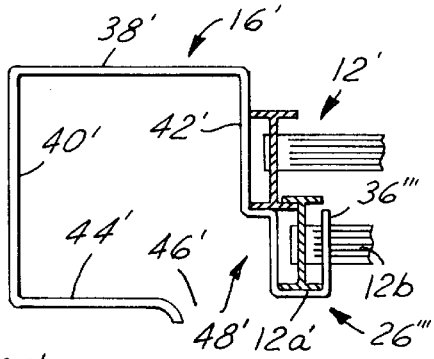
FIG. 6B is a partly sectional top plan view of a bracket member according to the present invention interfaced with a ladder, wherein the ladder is a "light duty" type extension ladder.

FIGS. 6A and 6B show a variation of the support member 14' and bracket member 16' adapted for use with "light duty" extension ladders 12' (the other Figures show adaptation for straight ladders, "heavy duty" extension ladders, step ladders, etc). Light duty extension ladders 12' have the side rail 12*a'* of the extension ladder component ELC' offset in relation to the side rail 12*a"* of the base ladder component BLC'. Thus, the rung hocks 26", 26"' are configured to include a side rail accommodating offset 48, 48'.

With regard to the support member 14', included are a bottom wall 22', sidewalls 24' and a rung hook 26" having an offset 48, as shown at FIG. 6A. A section 24*a"* of the sidewall 24*a'* abuts the side rail 12*a"* of the base ladder component BLC'. A first leg 48*a* of the offset 48 abuts the front side F" of the side rail 12*a',* and a second leg 48*b* of the offset abuts the side rail 12*a'* of the extension ladder component ELC'. The stand-off 30", flange 34" and projection 36" are each structured and operate with respect to the side rail 12*a'* and rung 12*b* as recounted hereinabove with respect to the support member 14, inclusive of two rung hooks being located at opposite sidewalls thereof. The first leg 48*a* is spaced from the stand-off 30" a distance O, which is the distance between the front sides F', F" of the respective side rails 12*a',* 12*a".* Further, the stand-off 30" is generally parallel to, and in line with, the front sidewall 24*c'.*

With regard to the bracket member 16', there is sufficient similarity between the rung hooks 26", 26"' that a full recounting of the structural details is unnecessary. Nonetheless, FIG. 6B depicts a bracket member 16' having a rear bracket portion 38' a right bracket portion 40', a boss bracket portion 44' and a left bracket portion 42' which connects with the rung hook 26"'. The opening 46' is now formed between the second leg 48*b'* of the offset 48' and the boss bracket member 44'. The offset 48' and the remainder of the rung hook 26"' interface with the light duty extension ladder 12' as recounted with regard to FIG. 6A, where now the projections 36"' are (as recounted hereinabove with respect to the bracket member 16) diametrically opposed to allow for either side of the ladder to be interconnected therewith by merely inverting the bracket member.

Figure 7:
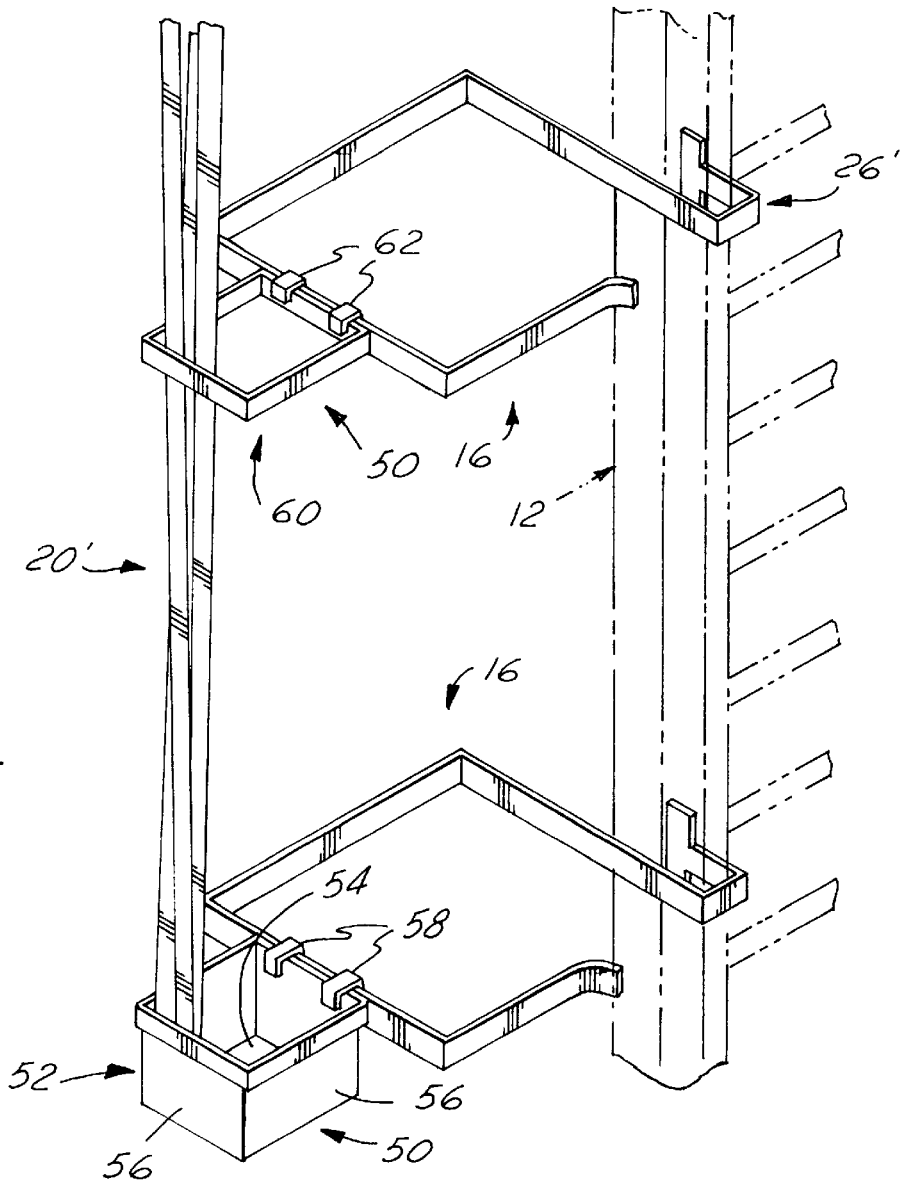
FIG. 7 is a perspective view of the bracket members according to the present invention interfaced with a ladder, wherein a secondary ladder rack system according to the present invention is shown.

FIG. 7 depicts an auxiliary ladder rack system 50 for holding light, elongated articles 20', such as for example trim pieces. A tray 52 having a cup-like, preferably rectilinear shape is provided having a bottom wall 54 and sidewalls 56. Clips 58 clippingly connected a sidewall 56 to either a bracket member 16 or a sidewall 24 of the support member 14. A guide bracket 60 is provided which clippingly engages, via clips 62, a bracket member 16 spaced from the tray 52.

Figure 8:
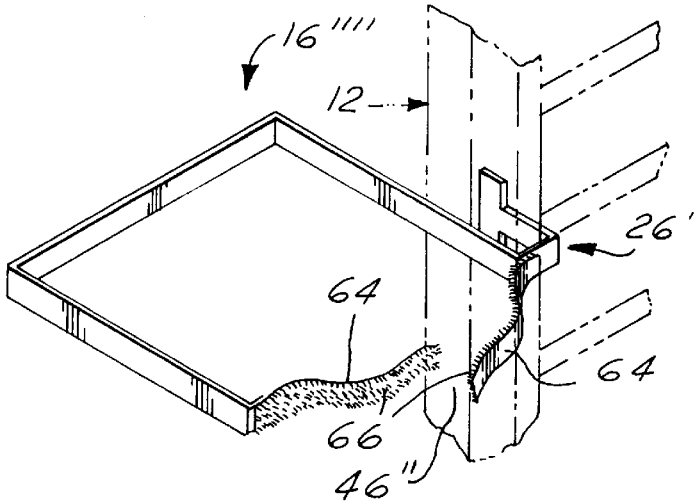
FIG. 8 is a perspective view of an alternative form of bracket member according to the present invention, shown interfaced with respect to a ladder.

FIG. 8 depicts a variation of the bracket member 16"", wherein rather than a boss bracket member for partially occluding the opening, a flexible strap 64 is used to selectively fully occlude the opening 46", having an interconnection mechanism 66, such as for example a two component hook and loop fastener, such as VELCRO (trademark of Velcro, USA). The strap 64 has the advantage of fully entrapping the elongated articles, but has the disadvantage of having to be opened and closed repeatedly as elongated articles are added or removed out of the opening 46".

As noted, the cross-section of the bottom wall of the support member and the cross-section of the bracket member should be dimensionally the same in order to provide in line support of the elongated articles with respect to the rear sidewall 24*b* and each rear bracket portion 38. Further, the cross-sections are preferred to be rectilinear so that the rear sidewall 24*b* and each rear bracket portion 38 are straight and flat for restably receiving the elongated articles without bunching, as would undesirably occur if the rear sidewall and the rear bracket portion where curved. E this regard, having the elongated articles in a linear, unbunched, arrangement along the rear sidewall and each rear bracket portion facilitates selection of individual elongated articles and its ease of removal with respect to the others from the ladder rack system 10.

Finally, it should be noted that the support member 14 may be used alone, or with the bracket members, for supporting various nonelongated articles, such as for example tools.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A ladder rack system for supporting elongated articles adjacent a ladder, said ladder rack system comprising:

a support member comprising:

support means for supporting an end of elongated articles; and first rung hock means connected with said support means for abuttably interfacing with a selected side rail of a ladder and for hookably interfacing with at least one selected rung of the ladder to thereby connect said support member to the ladder; and at least one bracket member comprising:

bracket means for supporting the elongated articles at at least one location spaced from said support member; and second rung hock means connected with said bracket member for abuttably interfacing with the selected side rail and for hookably interfacing with a rung other than the at least one selected rung to thereby connect said bracket member to the ladder at a location spaced from said support member;

wherein said bracket means comprises:

a rear bracket portion having a first end and a second end;

a right bracket portion connected at substantially a right angle to said first end of said rear bracket member; and a left bracket portion connected at substantially a right angle to said second end of said rear bracket member;

wherein an opening is formed between said right and left bracket portions opposite said rear bracket portion;

wherein said first and second rung hook means each comprise at least one rung hook, each said rung hook comprising:

a stand-off;

a flange connected with said stand-off at an orientation perpendicular thereto;

at least one projection connected with said flange at an orientation normal to both said stand-off and said flange; and offset means for being interfaceable with a side rail of a ladder wherein said offset means comprises a first leg being connected with one of said support means and said bracket means, said first leg being oriented parallel to said stand-off, and a second leg being connected with said first leg, said stand-off being connected to said second leg, said second leg being oriented parallel to said flange.

2. The ladder rack system of claim 1, wherein said support means comprises:

a bottom wall having a perimeter; and sidewalls connected in upstanding relation to said bottom wall at said perimeter;

wherein said sidewalls define a rectilinear cross-section, said bracket means having a rectilinear cross-section dimensionally similar to that of said sidewalls; and wherein said rear bracket portion is straight, and said sidewalls are flat.

3. The ladder rack system of claim 1, wherein said bracket means further comprises a boss bracket portion connected with said right bracket portion for partially occluding said opening.

4. The ladder rack system of claim 1, wherein said bracket means further comprises strap means connected with said right and left bracket portions for selectively occluding said opening.

5. The ladder rack system of claim 1, wherein said first leg of said second rung hook means is connected with said left bracket portion, and wherein said at least one projection of said second rung hook means comprises two diametrically opposed projections.

6. The ladder rack system of claim 5, wherein said first rung hook means further comprises two pairs of rung hooks, one pair of rung hooks, respectively, being located at each sidewall of opposing sidewalls of said support member, wherein each rung hook of each said pair of rung hooks are supportably interfaceable simultaneously with two selected rungs of the ladder.

7. The ladder rack system of claim 1, further comprising a secondary ladder rack system comprising:

tray means for holding an end of selected elongated articles; and means for clipping said tray means selectively onto one of said support member and said bracket member.

8. The ladder rack system of claim 7, wherein a secondary ladder rack system further comprises:

bracket means for entrappingly holding the selected elongated articles at a location spaced from said tray; and means for clipping said bracket means onto at least one bracket member.

9. A ladder rack for supporting articles adjacent the ladder, said ladder rack comprising a support member comprising:

a bottom wall having a perimeter; and sideways connected in upstanding relation to said bottom wall at said perimeter, said sidewalls including a rear sidewall; and rung hook means connected with said support member for abuttingly interfacing with a selected side rail of a ladder and for hookably interfacing with at least one selected rung of the ladder to thereby connect said support member to the ladder;

wherein said rung hook means comprises at least one rung hook comprising:

a stand-off;

a flange connected with said stand-off at an orientation perpendicular thereto, said flange having a flange length;

at least one projection connected with said flange at an orientation normal to both said stand-off and said flange; and offset means for being interfaceable with a ladder, wherein said offset means comprises a first leg being connected with said sidewalls at an orientation substantially parallel to said rear sidewall; said first leg being oriented parallel to said stand-off, and a second leg being connected with said first leg, said stand-off being connected to said second leg, said second leg being oriented parallel to said flange.

10. A rung hook for connecting an article to a ladder comprising:

a stand-off;

a flange connected with said stand-off at an orientation perpendicular thereto;

at least one projection connected with said flange at an orientation normal to both said stand-off and said flange; and offset means for being interfaceable with a ladder side rail, wherein said offset means comprises a first leg connectable to an article, said first leg being oriented parallel to said stand-off, and a second leg being connected with said first leg, said stand-off being connected to said second leg, said second leg being oriented parallel to said flange.

* * * * *